US008734171B2

(12) United States Patent
Cameron

(10) Patent No.: US 8,734,171 B2
(45) Date of Patent: May 27, 2014

(54) ELECTRICAL CONNECTOR HAVING A MECHANISM FOR CHOOSING A FIRST OR A SECOND POWER SOURCE

(76) Inventor: D Kevin Cameron, Sunnyvale, CA (US)

( * ) Notice: Subject to any disclaimer, the term of this patent is extended or adjusted under 35 U.S.C. 154(b) by 46 days.

(21) Appl. No.: 13/441,894

(22) Filed: Apr. 8, 2012

(65) Prior Publication Data

US 2012/0264316 A1 Oct. 18, 2012

Related U.S. Application Data

(60) Provisional application No. 61/475,413, filed on Apr. 14, 2011.

(51) Int. Cl.
*H01R 27/00* (2006.01)

(52) U.S. Cl.
USPC ..... 439/221

(58) Field of Classification Search
USPC ..... 439/218–224
See application file for complete search history.

(56) References Cited

U.S. PATENT DOCUMENTS

| | | | | |
|---|---|---|---|---|
| 4,666,223 | A * | 5/1987 | Tillmann | 439/221 |
| 6,520,787 | B1 * | 2/2003 | Lott | 439/218 |
| 6,573,621 | B2 * | 6/2003 | Neumann | 307/150 |
| 6,634,896 | B1 * | 10/2003 | Potega | 439/218 |
| 7,101,226 | B1 * | 9/2006 | Gilliland | 439/620.01 |
| 7,771,202 | B2 * | 8/2010 | Amotz et al. | 439/39 |
| 8,465,310 | B2 * | 6/2013 | Walls, Jr. | 439/218 |
| 2003/0207603 | A1 * | 11/2003 | Potega | 439/218 |

* cited by examiner

*Primary Examiner* — Chandrika Prasad
(74) *Attorney, Agent, or Firm* — Better IP

(57) ABSTRACT

A method and apparatus for modifying standard AC plugs and receptacles to flexibly furnish AC or DC power is disclosed. This can be accomplished by adding a "selector" pin between the non-ground pins used in traditional AC plugs. Alternately, an interposer can be manually applied to the plug to effect selection. Plug electronics can select AC or DC based on respective availability. A flexible power receptacle can manage AC/DC selection, regulate the supplied DC voltage and enable reversion to the AC supply if the DC supply is inadequate. Electronics within a flexible power receptacle can convert DC to AC when advantageous and can regulate the supplied voltage. Additional electronics within a flexible power plug or receptacle can enable communication.

18 Claims, 7 Drawing Sheets

ELECTRICAL CONNECTOR HAVING A MECHANISM FOR CHOOSING A FIRST OR A SECOND POWER SOURCE

CROSS REFERENCE TO RELATED APPLICATIONS

This application claims priority under 35 USC §119(e) to U.S. Provisional Patent Application No. 61/475,413, filed Apr. 14, 2011, titled "METHOD AND APPARATUS FOR FLEXIBLE DISTRIBUTION OF AC OR DC POWER USING WALL PLUGS," the entire contents of which are herein incorporated by reference.

FIELD OF TECHNOLOGY

This disclosure relates generally to the technical fields of electrical power distribution, and in one example embodiment, this disclosure relates to a method, apparatus and system of distributing AC and DC power to residential appliances.

BACKGROUND

Renewable electrical energy sources such as wind and solar naturally furnish DC power. Meanwhile, many electronic devices for the home, lab and other environments are designed to accept AC power and internally convert to DC. The requisite power conversion electronics add complexity and dissipate power. It is therefore desirable to enable such devices to directly utilize DC power furnished by renewable sources. Adoption of power plugs having a new physical configuration is unlikely to be viable; thus it is desirable to adapt standard AC plugs and receptacles to flexibly furnish power from either AC or DC power sources as appropriate for the devices of interest.

SUMMARY

Standard AC plugs and receptacles can be modified to flexibly furnish power from AC or DC power sources as appropriate for appliances of interest. For example, adding a "selector" pin between the non-ground pins traditionally used in an AC power plug allows AC or DC to be selected and supplied. Alternately, an interposer can be applied to standard AC plugs to select AC or DC from a flexible receptacle.

Electronics embedded in a power receptacle can make decisions based on availability, so that, for example, if DC is not available, then AC will be supplied. A flexible power receptacle can manage AC/DC selection, regulate the supplied DC voltage and enable reversion to the AC supply if the DC supply is inadequate. Electronics within a flexible power receptacle can convert DC to AC when advantageous and can regulate the supplied voltage. Additional electronics within a flexible power plug or receptacle can enable communication, for example with an Energy Management system.

Other features of the present embodiments will be apparent from the accompanying drawings and from the detailed description that follows. The methods, systems, and apparatuses disclosed herein may be implemented in any means for achieving various aspects, and may be executed in a form of a machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE VIEW OF DRAWINGS

Example embodiments are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

A method and apparatus for flexible distribution of AC or DC power using wall plugs and receptacles is disclosed. In the following description, for the purposes of explanation, numerous specific details are set forth in order to provide a thorough understanding of the various embodiments. It will be evident, however, to one skilled in the art that various embodiments may be practiced without these specific details.

Figure 1:
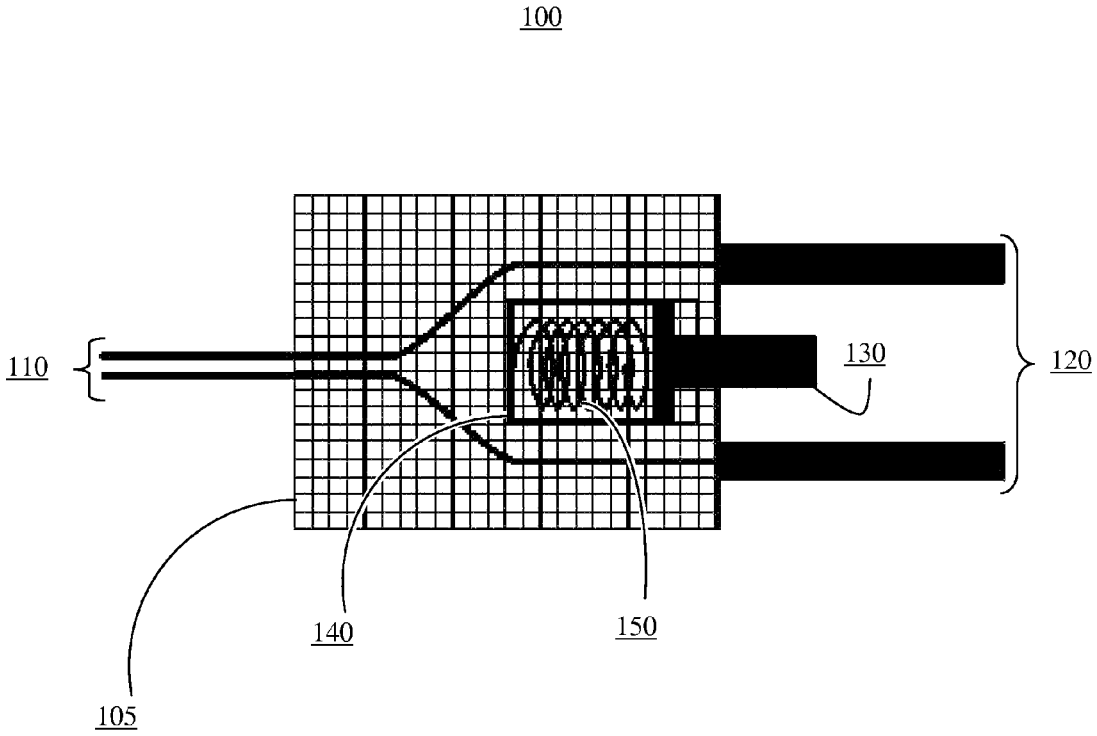
FIG. 1 is a functional diagram of a plug for flexibly accepting AC or DC power, according to one or more embodiments.

Domestic AC power plugs comprise a three-contact or "three-pin" grounded, or "earthed" version, and a two-contact or "two-pin" non-grounded version. From an electrical standpoint, such plugs can also receive DC power, and can be retrofitted with means of selecting AC or DC power from a flexible power receptacle. Referring now to FIG. 1, adding an extra "selector" pin mechanism 130 between the non-ground pins 120 normally used to supply power to wires 110 allows selector pin mechanism 130 to mechanically drive a switch in a mating receptacle which will change the supplied power from AC to DC. Selector pin mechanism 130 is contained within cavity 140 of housing 105 and is loaded by spring 150 such that it can be pushed back into housing 105 by a force sufficient to overcome the tension of spring 150. Selector pin mechanism 130 may be comprised of a conductive or a non-conductive material. Analogous results can be achieved using selection mechanisms that function by supplying a magnetic or electromagnetic field or optical stimulus for actuation. Use of mechanical or optical stimuli advantageously provides immunity to electromagnetic interference.

Figure 2:
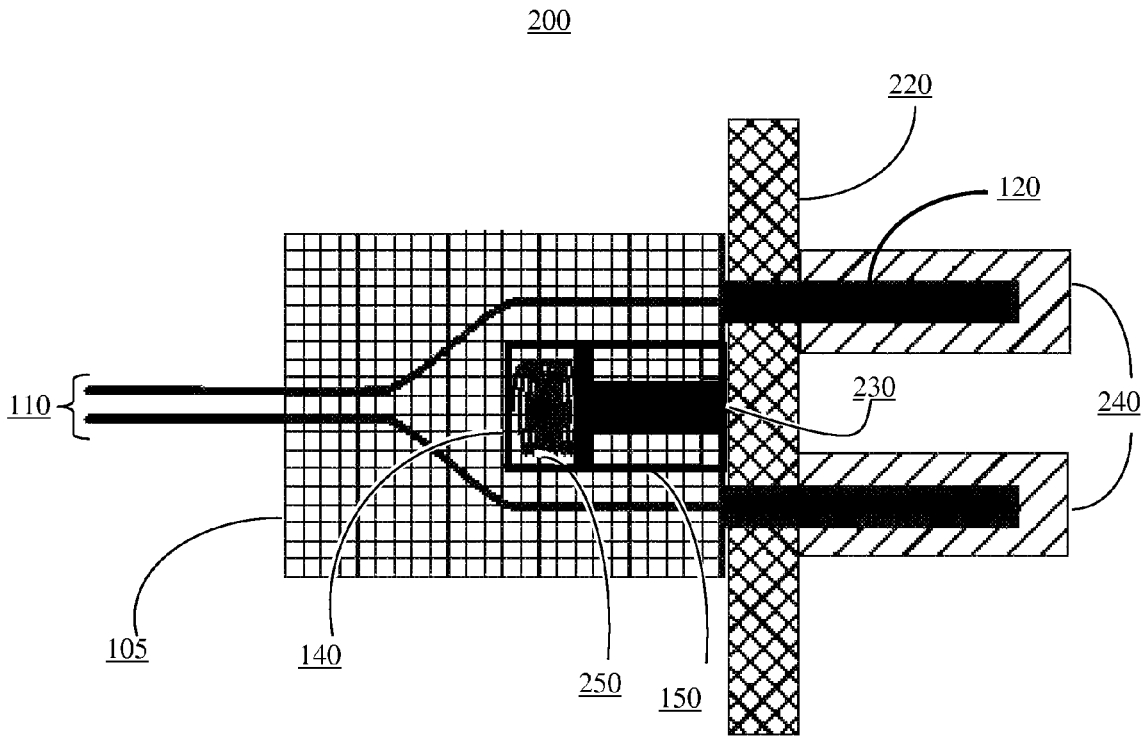
FIG. 2 is a functional diagram showing a plug for flexibly accepting AC or DC power inserted into an AC-only receptacle, according to one or more embodiments.

Referring now to FIG. 2, for the mechanical case, when plug 100 is used with a traditional (AC-only) receptacle comprising plate 220 and electrical contacts 240, selector pin mechanism 230 is pushed into and substantially contained within cavity 140 of the receptacle.

Figure 3:
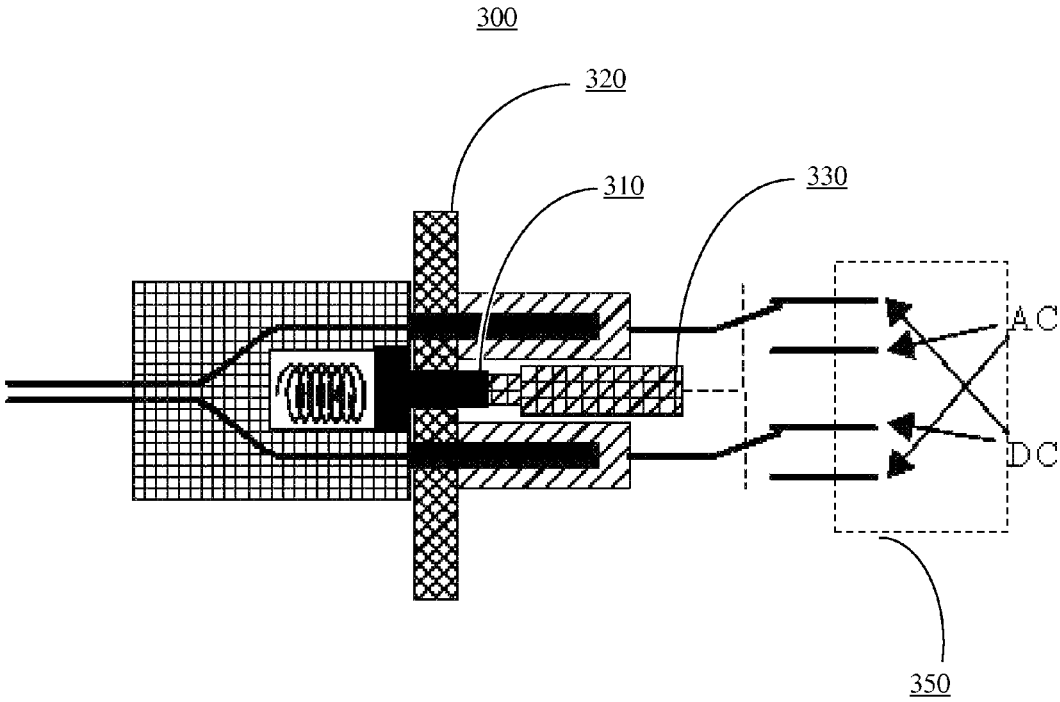
FIG. 3 is a functional diagram showing a plug for flexibly accepting AC or DC power inserted into a receptacle capable of supplying AC or DC power, according to one or more embodiments.

Referring now to FIG. 3, when the plug is used with a receptacle capable of supplying either AC or DC, selector pin mechanism 310 will move into the receptacle slider 330 which is more lightly sprung than selector pin mechanism 310. This actuates switch 350 in the receptacle to select DC power. Switch 350 may effect the selection mechanically, or it may do so indirectly, for example, through electronics. Such electronics can make decisions based on availability, so that, for example, if DC is not currently available, then AC will be supplied. One power line and power pin can be shared between the AC and DC sources (for example, the "neutral"), so that switching only one other line (the "live" wire) is required.

Figure 4A:
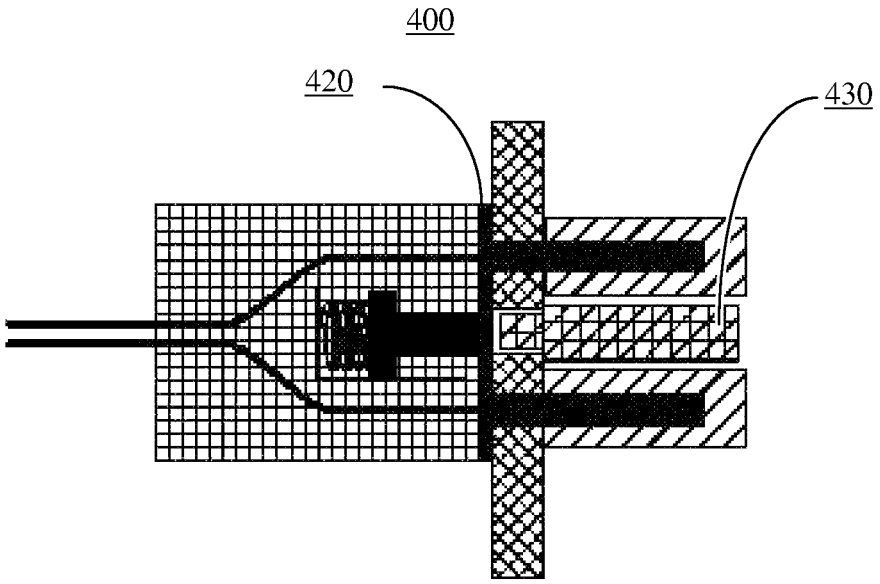
FIG. 4A is a functional diagram showing a plug for manually selecting AC or DC power adapted to accept AC power, according to one or more embodiments.
Figure 4B:
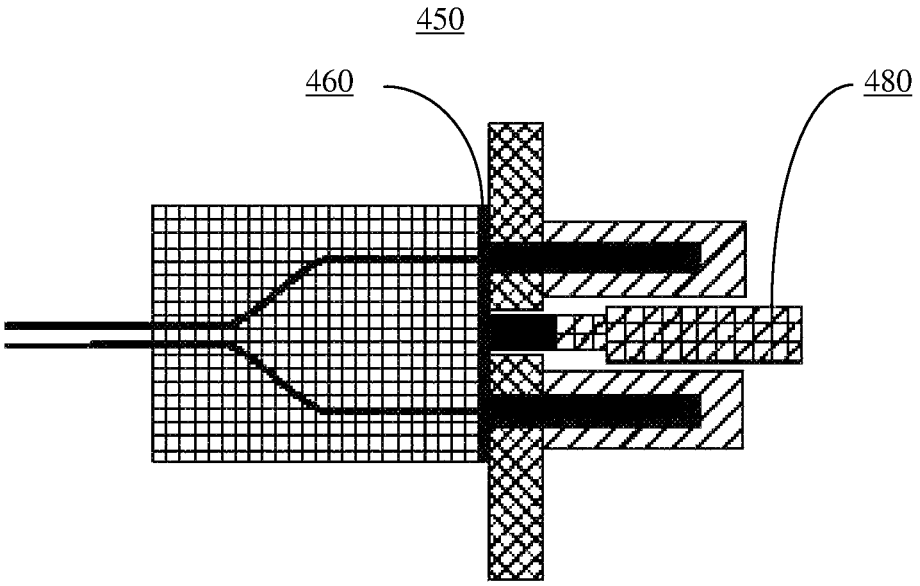
FIG. 4B is a functional diagram showing a plug for manually selecting AC or DC power adapted to accept DC power, according to one or more embodiments.

As an alternative to a spring loaded indicator pin, a manual selecting device can be attached that allows the end user to manually choose between an AC or DC source. For example, FIG. 4A shows an attached thin non-conductive actuating plate or "interposer" 420 without a pin that causes selector pin mechanism 310 to be contained within cavity 140 so as to select AC. Such interposer can be compatible with traditional AC-only receptacles and operates by preventing translation of slider 430. Referring now to FIG. 4B, an alternate actuating interposer 460 having a pin can be attached to a traditional AC plug to manually select DC by causing slider 480 to translate and actuate an AC/DC selection switch. Persons skilled in the art will appreciate that DC selection and operation can be advantageous for certain kinds of equipment such as that designed for multi-region use, since power will not be lost as a consequence of AC-to-DC conversion that would otherwise be required. DC selection may be inadvisable for other types of equipment, such as transformer-operated devices, or those that would be adversely affected if the RMS voltages of the AC and DC supplies differ significantly. Thus, with manual selection, the user can control which equipment is eligible to receive DC power to avoid negative consequences.

The receptacle can include electronics to manage AC/DC selection, and such electronics may also regulate the supplied DC output voltage during and after selection, for example, to regulate RMS voltage. This approach also can allow reversion to the AC supply if, for example, the DC from renewable sources is incapable of supplying sufficient power to operate a particular device or appliance. Similarly, a mating plug can utilize physically contained electronics to monitor and/or regulate or otherwise control the received power, for example, by monitoring and/or regulating the received RMS voltage.

Some markets mandate that solar power inverters disconnect from the AC grid in the event of a grid power failure. In such event, solar power may still be available. For maintaining operation of critical equipment such as medical and computing devices during grid outages, electronics within the receptacle can switch over to the active DC supply and convert the active DC to AC. Such receptacle electronics can additionally regulate the supplied voltage as required.

Additional electronics may be added to the plug or receptacle to enable communication with an Energy Management system, such as, for example, a Smart Grid system. Such electronics could also implement logic to switch an attached device on or off depending on circumstances. For example, if a refrigerator that requires AC at substantial current levels is connected, it can be switched off when the Energy Management system decides to limit consumption or when only DC is available.

Figure 5:
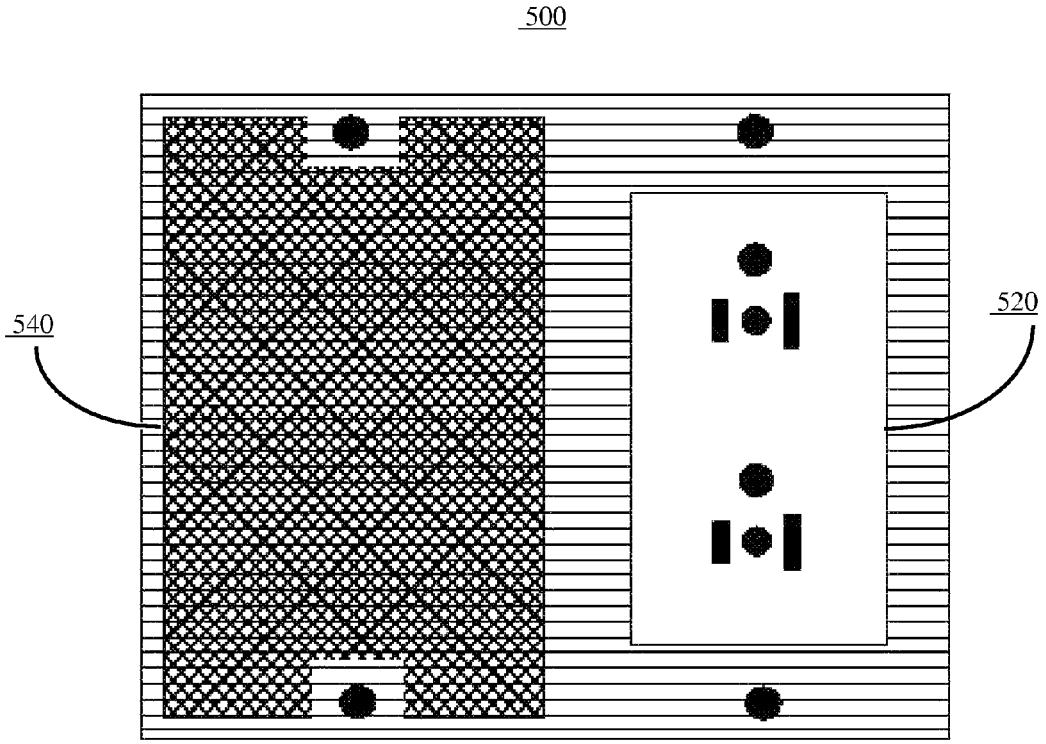
FIG. 5 is a functional diagram showing a receptacle for providing AC or DC power, according to one or more embodiments.

Other functionality can be implemented within the receptacle. For example, referring to FIG. 5, in addition to securing power receptacle 520, some of the receptacle faceplate area can function as a heatsink 540 or provide ventilation for any embedded electronics. The heatsink may be flush or have fins or vanes to increase surface area. LEDs or other visual feedback may be added to indicate status. A dual receptacle 520 could furnish either AC or DC from either receptacle as described above. Alternately, a dual receptacle 520 could be designed to furnish AC only from one section and DC only from a second section.

Figure 6:
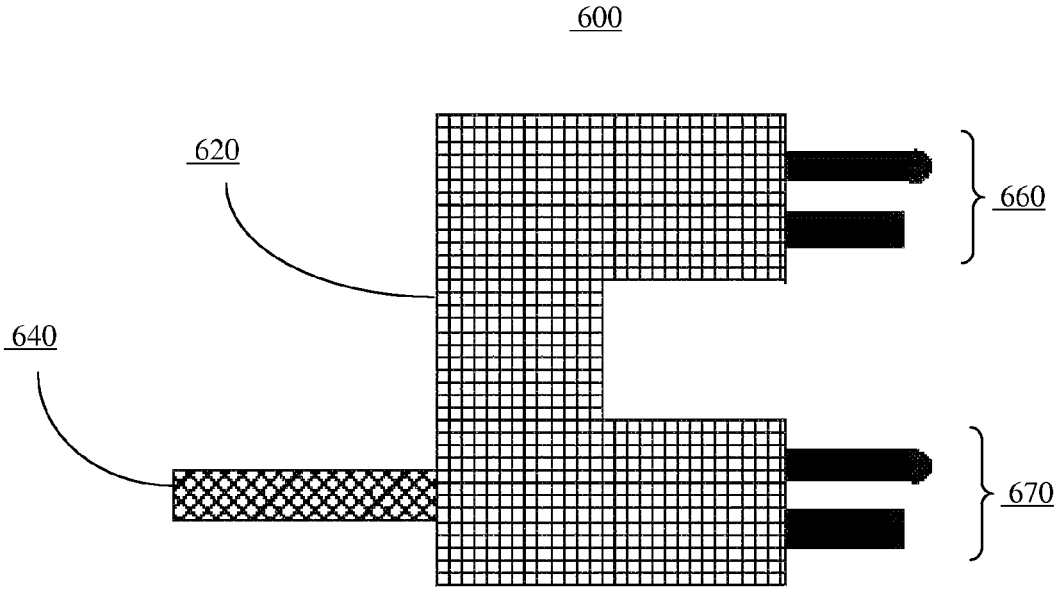
FIG. 6 shows DC and AC power plugs combined within a common housing, according to one or more embodiments.

Referring now to FIG. 6, a compatible power extension cable 600 can integrate a DC plug 660 and an AC plug 670 within a common housing 620. Cable 640 carries the DC and AC power. The relative orientation of the DC and AC plugs is flexible. The power extension receptacle at the other end of cable 640 would similarly integrate DC and AC receptacles to enable "daisy chaining." Power extension cable 600 can also include inverter electronics to provide attached equipment with AC power converted from a DC source. For economy, flexibility or reduced size, power extension cable 600 may include a single receptacle that switches between AC and DC.

Figure 7:
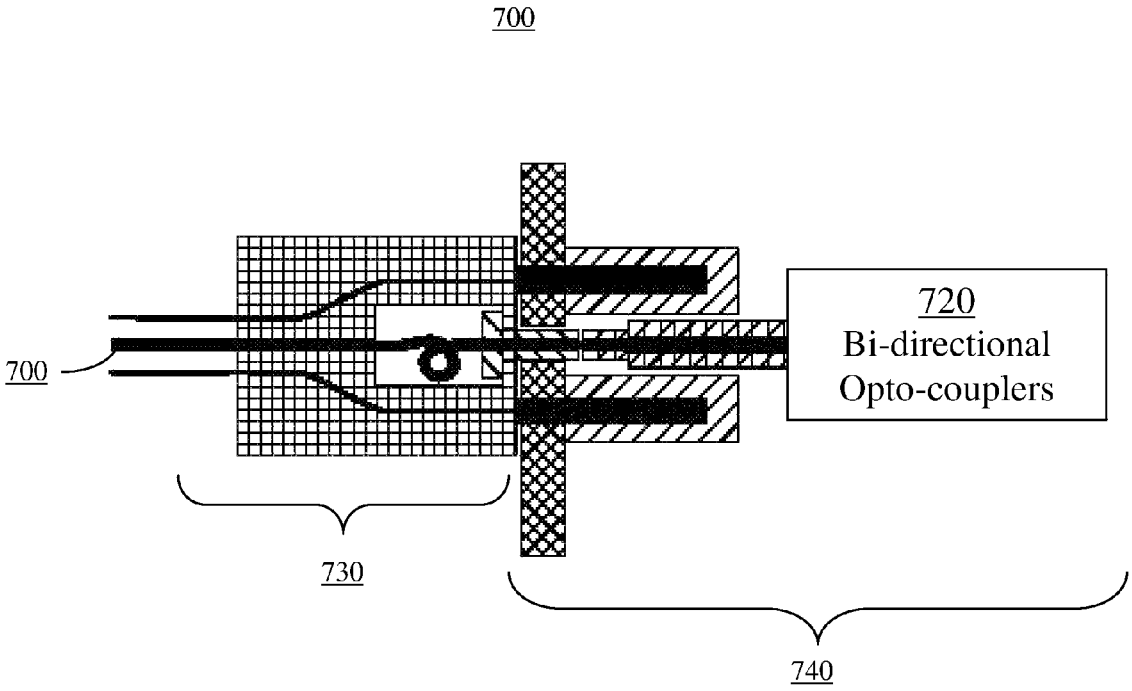
FIG. 7 shows a plug with integrated fiber optic cable, according to one or more embodiments.

FIG. 7 shows how a power receptacle of the type described may additionally support communications such as analog signal communications or digital data communications. For example, fiber optic cable and opto-coupler assembly 720 runs through the selecting pin within receptacle 740 and mates with a corresponding fiber optic cable 700 in plug 730 via opto-couplers. Possible variations comprise magnetic and electromagnetic cables and couplers to support communications via analogous transducing devices.

Possible standards that such a communications link might support are SPDIF (for audio application) and Thunderbolt™. If the receptacle control electronics interfaces with an IP network and the protocol of the connecting device is not IP-compatible, the receptacle may act as a server. For example, a connecting device with SPDIF protocol can access a TCP/IP port of the receptacle and be announced to the IP network. A power extension cord with multiple receptacles could include a communications hub to manage multiple devices. This approach can also be applied to an AC-only receptacle, wherein a pin similar to that described above is used to turn on the communication electronics. This prevents the communication electronics from unnecessarily drawing power when communications is not required.

Those of skill in the art will appreciate additional alternative designs for a method and apparatus for modifying standard AC plugs and receptacles to flexibly furnish AC or DC power. Thus, it is to be understood that the invention is not limited to the precise construction and components disclosed herein and that various modifications, changes and variations which will be apparent to those skilled in the art may be made in the arrangement, operation and details of the method and apparatus of the invention disclosed herein without departing from the spirit and scope of the invention as defined in the appended claims.

I claim:

1. A receptacle for supplying electrical power, the receptacle comprising:

a first and a second electrical contact for supplying the electrical power from either a first or a second power source to a mating apparatus;

a selecting mechanism for choosing either the first or the second power source in response to an actuation from the mating apparatus; and a housing containing the first and the second electrical contacts and the selecting mechanism.

2. The receptacle of claim 1, wherein the actuation from the mating apparatus is one of a physical actuation, an optical actuation, a magnetic field actuation and an electromagnetic field actuation.

3. The receptacle of claim 1, further comprising a third electrical contact.

4. The receptacle of claim 1, wherein the apparatus is backward compatible with an alternating current-only mating apparatus.

5. The receptacle of claim 1, further comprising one or more of a regulator for controlling the supplied electrical power, a direct current-to-alternating current converter, and a power switch to switch the supplied power to alternating current power or direct current power.

6. The receptacle of claim 1, further comprising a heatsink for heat dissipation.

7. The receptacle of claim 1, further comprising a coupler for receiving a communications signal from the mating apparatus or transmitting a communications signal to the mating apparatus.

8. The receptacle of claim 1, further comprising a switch that selects the first or the second power source in response to the actuation from the mating apparatus.

9. The receptacle of claim 1, further comprising means to determine whether power is supplied from the first or the second power source.

10. The receptacle of claim 7, further comprising a communications server.

11. The receptacle of claim 1, further comprising means for communicating with an energy management system.

12. The receptacle of claim 1, physically configured according to a standard 110 Volt RMS alternating current wall socket.

13. A plug for receiving electrical power, the plug comprising:

a first and a second electrical contact for receiving electrical power from a receptacle capable of furnishing electrical power from a first or a second power source;

a selecting mechanism for selecting electrical power delivery from the first or the second power source; and a housing containing the first and the second electrical contacts and the selecting mechanism.

14. The plug of claim 13, wherein the selecting mechanism IS a physical mechanism contained by the housing.

15. The plug of claim 13, wherein the selecting mechanism functions by stimulating the receptacle with one or more of a magnetic field, an electromagnetic field, and an optical stimulus.

16. The plug of claim 13, further comprising one or more of an opto-coupler for receiving or transmitting a signal, a controller to control the received electrical power, a monitor to evaluate the received electrical power, and means for communicating with an energy management system.

17. The plug of claim 13, wherein the first power source is an alternating current power source and the second power source is a direct current power source.

18. An apparatus for extending electrical power, the apparatus comprising:

a plug for receiving the electrical power from a receptacle capable of supplying the electrical power from a first or a second power source;

a socket for supplying the electrical power from the first or the second power source to a mating apparatus, the socket containing a first and a second electrical contact; and a mechanism for selecting the first or the second power source in response to an actuation from the mating apparatus.

* * * * *